US005526541A

United States Patent [19]

Massey et al.

[11] Patent Number: 5,526,541

[45] Date of Patent: Jun. 18, 1996

[54] PATIENT TRANSFER STAND

[76] Inventors: Jonathan W. Massey; James H. Massey, both of 6828 E. Oak St., Scottsdale, Ariz. 85257

[21] Appl. No.: 311,683

[22] Filed: Sep. 23, 1994

[51] Int. Cl.[6] ..... A61G 7/14; A61G 7/10

[52] U.S. Cl. ..... 5/81.1 RP; 5/86.1; 5/89.1

[58] Field of Search ..... 5/81.1, 86.1, 89.1, 5/507.1

[56] References Cited

U.S. PATENT DOCUMENTS

| | | | |
|---|---|---|---|
| 2,757,388 | 8/1956 | Chisholm | 5/81.1 |
| 2,963,713 | 12/1959 | Forrest | 5/81.1 |
| 2,975,435 | 3/1961 | Forrest | 5/81.1 |
| 4,279,043 | 7/1981 | Saunders | 5/81.1 |
| 4,305,579 | 12/1981 | Rice | 272/156 |
| 4,829,612 | 5/1989 | Adams | 5/81.1 |
| 4,934,003 | 6/1990 | Hayakawa et al. | 5/81.1 |
| 4,981,307 | 1/1991 | Walsh | 5/89.1 |
| 5,384,922 | 1/1995 | Jobe | 5/81.1 |

*Primary Examiner*—Alexander Grosz
*Attorney, Agent, or Firm*—Tom Hamill

[57] ABSTRACT

A patient transfer stand is provided for assisting a wheelchair-bound person to transfer to and from a wheelchair to a variety of other points in a simple fashion. The transfer stand includes a rotating base. The base includes 2 substantially rectangular cut out portions that accommodates the wheels of the wheelchair. The base supports a pair of vertical support bars, in addition to an elevated handle structure that the wheelchair-bound person can hold onto during transfer. The elevated handle structures include elastic straps which may be used to assist the wheelchair-bound person from the wheelchair into the patient transfer stand. A patient, if required, may utilize the elastic straps attached to a belt or harness worn about the waist to assist them in assuming a standing position inside the transfer stand. Through the utilization of developed leverage, the patient may assume a raised or semi-standing position in the transfer stand without assistance. The patient may also use hand holds or handles while they are assuming the standing position. Once the patient has assumed the upright position on the transfer stand, the stand is rotated and the person may sit or recline on the desired object—such as the bed or commode. A means to secure the person inside the transfer stand during transfer may also be provided.

17 Claims, 4 Drawing Sheets

PATIENT TRANSFER STAND

BACKGROUND OF THE INVENTION

1. Field of the Invention

The present invention relates generally to devices for assisting the physically challenged, and more particularly, to a rotational transfer apparatus by which a wheelchair-bound individual may be transferred to or from the wheelchair from a variety of other locations, including, but not limited to, a commode, bed or sofa.

2. Description of the Prior Art

Devices for rotating an individual with the intent of transferring that individual from one point to another in the form of a rotating transfer apparatus are known in the art of medical devices. U.S. Pat. No. 2,757,388 issued to Chisholm discloses a bedside transfer stand. This device would assist a person in the procedure of bed to wheelchair transfers. This device is non-adjustable in vertical height, and does not include an efficient means of assisting someone who is more seriously disabled into an upright position. This device also does not include generally rectangular cut-outs or rectangular apertures in its base designed to receive the wheels of the wheelchair.

U.S. Pat. No. 2,963,713 issued to Forrest discloses an invalid transfer apparatus. This apparatus is vertically adjustable to accommodate any size user. This device does not include an efficient means of assisting someone who is more seriously disabled into an upright position. Also, this device does not include generally rectangular cut-outs or rectangular apertures in its base that are designed to receive the wheels of the wheelchair.

U.S. Pat. No. 4,279,043 issued to Saunders discloses a transfer stand. This stand includes wheels in the form of castors, a provision to convert the device into a wheelchair, and a means to incorporate vertically adjustable crutches. This device does not include an efficient means of assisting someone who is more seriously disabled into an upright position. This device also does not include generally rectangular cut-outs or apertures in its base that are designed to receive the wheels of the wheelchair.

Thus, while the foregoing body of prior art indicates it to be well known to use rotatable transfer devices, the provision of a device which more completely assists in the patient transfer which is simple and cost effective is not contemplated. The prior art described above does not teach or suggest a transfer device which incorporates elastic elements attached to the body of the device as well as the patient which assists the patient into acquiring a standing position within the patient transfer stand. The prior art devices do not include a band structure which is connected to the transfer device for retaining and securing the patient in such a manner to insure safety and stability during the transfer process. The prior art devices also do not contemplate the incorporation of apertures, slots or rectangular cutouts in the turnable base that would receive the wheels of a wheelchair. The foregoing disadvantages are overcome by the unique elastic bands and rectangular cutouts of the present invention, as will be made apparent by the following description thereof. Other advantages of the present invention over the prior art will also be rendered evident.

SUMMARY OF THE INVENTION

To achieve the foregoing and other advantages, the present invention, briefly described, provides a patient transfer stand for assisting a wheelchair-bound person in transferring to and from a wheelchair to and from a variety of other points in a simple and assisted fashion. Generally speaking, those confined to wheelchairs (those who would be utilizing the patient transfer stand) may not possess the physical prowess required to lift themselves upright without assistance. The transfer stand includes a base that rotates. The base is notched or contains cut-outs in order to receive and accommodate the wheels of the wheelchair. The base supports a pair of vertical support bars and elevated handle structure that the wheelchair-bound person can hold onto during transfer. The elevated handle structures include elastic straps, which may be referred to as assist bands, for assisting the wheelchair-bound person from the wheelchair into the patient transfer stand. The elastic straps also help the patient return to a sitting position by slowing their rate of descent during the act of sitting. The straps are attached to a belt or harness worn by the person, allowing the elastic or spring force to help pull them up and to acquire a standing position inside the transfer stand. Hand holds or handles are provided on the transfer stand for the person to hold onto while they are in a raised, semi-standing or standing position. Once the person is on the transfer stand, the stand is rotated by an assistant and then person may then sit or recline on the desired object, such as a bed or commode. A retaining band may be provided on the patient transfer stand to secure the patient in a safe and secure fashion which would prevent accidental discharge of the patient from the apparatus.

It is envisioned that the patient transfer stand will be used in homes for personal use, at hospitals, nursing homes, and other institutions, including those which care for the elderly. Other uses may include permanent storage in handicapped oriented bathrooms in public areas to facilitate a wheelchair bound person to more freely utilize such facilities.

The above brief description sets forth rather broadly the more important features of the present invention in order that the detailed description thereof that follows may be better understood, and in order that the present contributions To the art may be better appreciated. There are, of course, additional features of the invention that will be described hereinafter and which will form the subject matter of the claims appended hereto.

In this respect, before explaining at least the preferred embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description, and should not be regarded as limiting.

As such, those skilled in the art will appreciate that the conception upon which this disclosure is based, may readily be utilized as a basis for designing other structures, methods and systems for carrying out the several purposes of the present invention. It is important, therefore, that the claims be regarded as including such equivalent constructions, insofar as they do not depart from the spirit and scope of the present invention.

Further, the purpose of the foregoing Abstract is to enable the U.S. Patent and Trademark Office as well as the public in general (especially scientists, engineers and practitioners in the art who are not familiar with patent or legal terms of phraseology) to determine the nature and essence of the technical disclosure of the application from a quick cursory inspection. Accordingly, the Abstract is neither intended to define the invention or the application, which only is measured by the claims, nor is it intended to be limiting as to the scope of the invention in any way.

It is therefore an object of the present invention to provide a new and improved patient transfer stand which has all of the advantages of the prior art and none of The disadvantages.

It is another object of the present invention to provide a new and improved patient transfer stand which may be easily and efficiently manufactured and marketed.

It is a further objective of the present invention to provide a new and improved patient transfer stand which is of durable and reliable construction.

An even further object of the present invention is to provide a new and improved patient transfer stand which is susceptible of a low cost of manufacture with regard to both materials and labor, and which accordingly is then susceptible of low prices of sale to the consuming public, thereby making such patient transfer stand available to the buying public.

Still yet a further object of the present invention is to provide a new and improved patient transfer stand in which elastic strap means are provided to assist the patient into acquiring a raised, semi-standing or standing position on the patient transfer stand if such assistance is required or desired by the patient.

It is still a further object of the present invention to provide a new and improved patient transfer stand includes a waist belt or patient transfer belt secured to the patient allowing the patient to remain secure in the patient transfer apparatus during the complete transfer process, i.e. the raising and turning.

A further object of the present invention is to provide a new and improved patient transfer stand including means for permitting the wheelchair to approach and interact the apparatus, by providing cut-out sections in the base of the apparatus designed to receive the wheels of the wheelchair thus permitting the patient to develop leverage during the raising procedure.

These together, with still other objects of the invention—including means for establishing positive structural integrity and greater loadbearing capacity than other prior art devices—along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 3A is an exploded view of the telescoping vertical adjustment means of the patient transfer stand.

FIG. 3B is an exploded view of the telescoping adjustment means of the U-shaped hand grip handle.

DESCRIPTION OF THE PREFERRED EMBODIMENT

Figure 1:
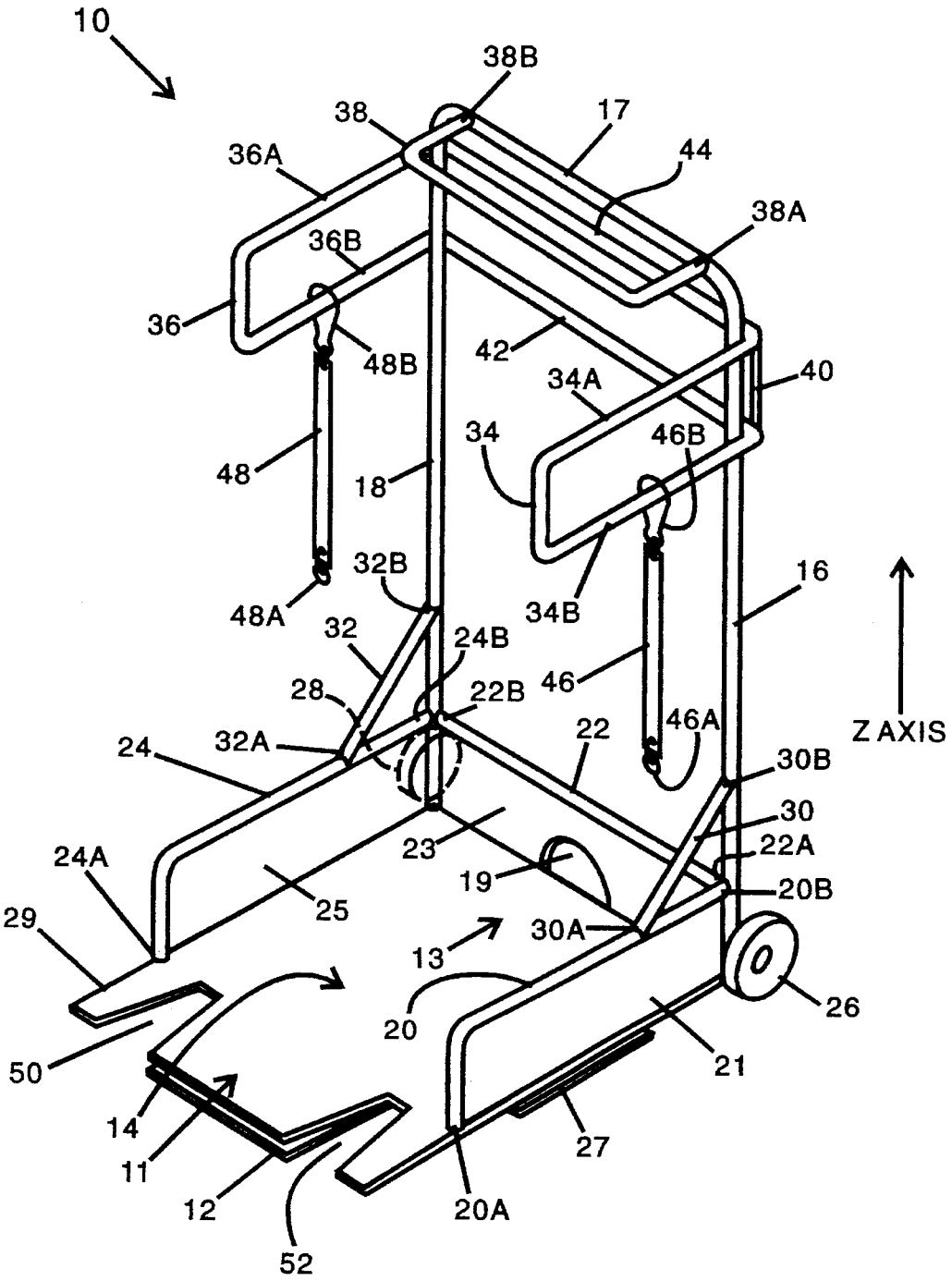
FIG. 1 is a perspective view showing the preferred embodiment of the patient transfer stand of the invention.
Figure 2:
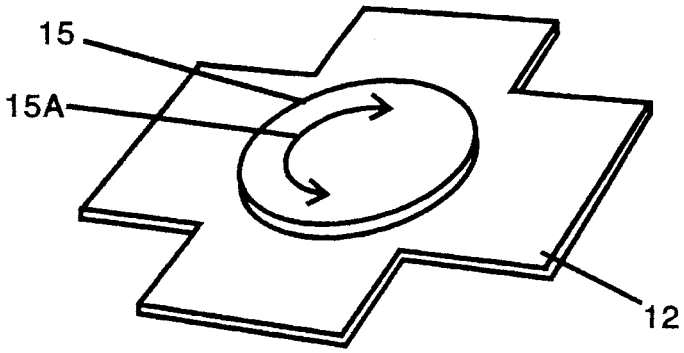
FIG. 2 is a partial exploded view showing the generally X-shaped bottom element of the patient transfer stand with the associated rotating bearing structure.
Figure 2A:
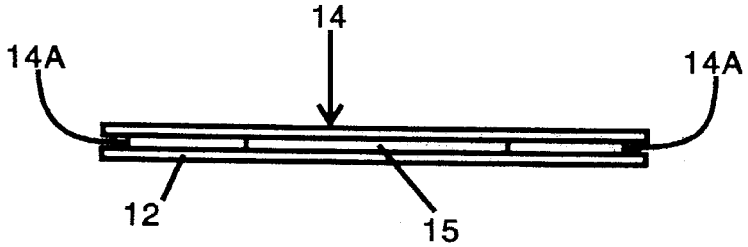
FIG. 2A is a side view of the generally X-shaped bottom element and the associated rotating bearing structure and the rotating plate structure of the patient transfer stand.
Figure 2B:
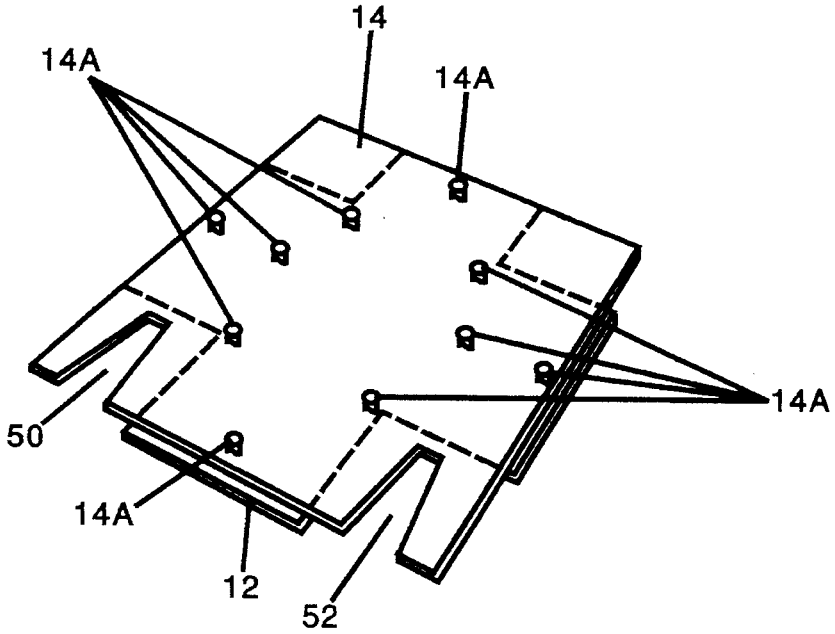
FIG. 2B is a view of the base of the patient transfer stand showing a configuration of the skid members.

With reference now to the drawings, a new and improved patient transfer stand embodying the principles and concepts of the present invention will be described.

Turning initially to FIGS. 1, 2, 2A, and 2B there is shown a first exemplary embodiment of the patient transfer stand apparatus of the instant invention generally designated by reference numeral 10. In its preferred form, the patient transfer stand 10 comprises generally a X-shaped base 12 which has a turning means 15 mounted centrally thereon. Arrow 15A indicates the direction of rotation of the turning means 15. The turning means 15 may be a race of bearings, or any other suitable turning means 15. The turning means 15 is sandwiched between the X-shaped base 12 and a E-shaped patient stand 14. The E-shaped patient stand 14 is a plate-like structure that the person can stand on while being transferred to or from the wheelchair. Nylon skids 14A are provided intermediate the X-shaped base 12 and stand 14 which stabilize the platform in regards to tilting. There are two cutouts or openings in the E-shaped patient stand 14, a left opening 50 and a right opening 52, these cutouts are located on the front portion 11 of the E-shaped patient stand 14. The left opening 50 and the right opening 52 are designed to receive the wheels of the wheelchair. This permits the wheelchair-bound person to bring the wheelchair closer to the patient transfer apparatus 10 then in prior art devices.

A right vertical tube 16 and a left vertical tube 18 extend vertically from the rear portion 13 of the E-shaped patient stand 14 and are connected thereto. A right wheel 26 is connected to the right vertical tube 16 and a left wheel 28 is connected to the left vertical tube 18. Wheels mobilize the structure, giving the patient transfer stand an ease of motion.

A right kickplate support tube 20 has a generally L-shaped configuration. It is connected to the right portion 27 of the E-shaped patient stand 14 at point 20A. The right kickplate support tube 20 is also connected to the right vertical tube 16 at point 20B. The right kickplate support tube 20 defines a plate support structure and receives a right kickplate 21. The right kickplate 21 is orientated vertically.

A left kickplate support tube 24 has a generally L-shaped configuration. It is connected to the left portion 29 of the E-shaped patient support stand 14 at point 24A. The left kickplate support tube 24 is also connected to the left vertical tube 18 at point 24B. The left kickplate support tube 24 defines a plate support structure and receives a left kickplate 25. The left kickplate 25 is orientated vertically.

A rear kickplate support tube 22 is a generally straight section of tube. The rear kickplate support tube 22 is connected to the right vertical tube 16 at point 22A. The rear kickplate support tube is also connected to the left vertical tube 18 at point 22B. The rear kickplate support tube 22 is in parallel relation to the E-shaped patient stand 14. The rear kickplate support tube 22, the right vertical tube 16, the left vertical tube 18 and the rear portion 13 of the E-shaped patient support stand 14 defines a plate support structure and receives a rear kickplate 23. The rear kickplate 23 is orientated vertically. A semi-circular opening 19 is located in the rear kickplate 23. This opening 19 permits the assistant to insert a foot to activate plate lock 5. Plate lock 5 utilizes a plunger mechanism which secures the stand 14 to the base 12. The assistant can disengage the plate lock 5 by depressing a deactivating switch located on the plate lock 5.

The right kickplate support tube 20, the rear kickplate support tube 22, and the left kickplate support tube 24 all lend to the structural stability of and permit increased loads to be carried by, the patient transfer apparatus 10.

A right structural support tube 30 is connected to the L-shaped right kickplate support tube 20 at point 30A. The right structural support tube 30 is also connected to the right vertical tube at point 30B. A left structural support tube 32 is connected to the L-shaped left kickplate support tube 24 at point 32A. The left structural support tube 32 is also connected to the left vertical tube 18 at point 32B. Both the right structural support tube 30 and the left structural support tube 32 lend structural integrity and increased loadbearing to the patient transfer apparatus 10.

The right vertical tube 16 and the left vertical tube 18 are connected at the top of the patient transfer apparatus 10 by a top horizontal tube 17. The top horizontal tube 17 is orthogonally orientated to both the right vertical tube 16 and the left vertical tube 18. The top horizontal tube 17 is in parallel relation to the E-shaped patient support stand 14 and the rear kickplate support tube 22. The top horizontal support tube 17 is coplanar with the rear kickplate support tube 22.

A U-shaped hand grip handle 38 is connected to the top horizontal tube at a point 38A which is proximal to the right support tube 16 and at a point 38B which is proximal to the left support tube 18. The hand grip handle 38 is telescopically adjustable as is best shown in FIG. 3B. A plurality of apertures (A) are provided on the hand grip handle 38 which would receive a mechanical device, the mechanical device would secure the hand grip handle at a specific length. The hand grip handle 38 is identical on both the right side 38A and the left side 38B in regards to the telescopic adjustment means. This handle is designed to allow the person who is being transferred to have something to hold onto at a proper height to develop and utilize the required leverage to be able to lift and stabilize themselves during the transfer process.

A generally U-shaped right stabilizing bar 34 is provided proximal the top of the patient transfer apparatus 10. A generally U-shaped left stabilizing bar 36 is provided proximal the top of the patient transfer apparatus 10. A first horizontal tube 44 is connected to the right stabilizing bar 34 top leg 34A and to the left stabilizing bar 36 top leg 36A. A second horizontal tube 42 is connected to the right stabilizing bar 34 bottom leg 34B and to the left stabilizing bar 36 bottom leg 36B. The first horizontal tube 44 and the second horizontal tube 42 are in parallel relation with each other and the top horizontal tube 17. A panel 40 is supported between the first horizontal tube 44 and the second horizontal tube 42. This panel 40 prevents objects from penetrating the internal area of the patient transfer apparatus 20, preventing injury or other mishaps. The first horizontal tube 44, the second horizontal tube 42 and the right stabilizing bar 34 and the left stabilizing bar 36 may be an integral, bent, generally rectangular (prior to bending), section of tubing. This section of tubing also lends structural support to the patient transfer apparatus 10.

Figure 4:
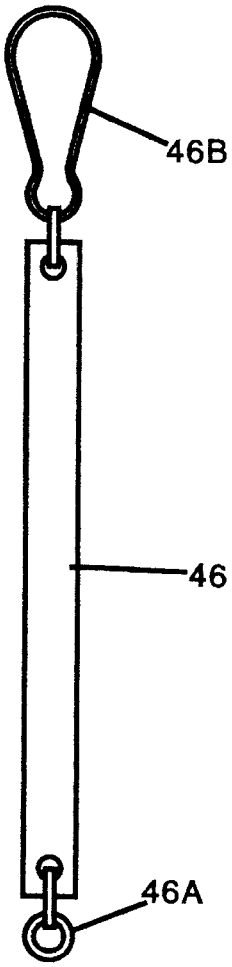
FIG. 4 is a view of the elastic assist band of the instant invention.
Figure 5:
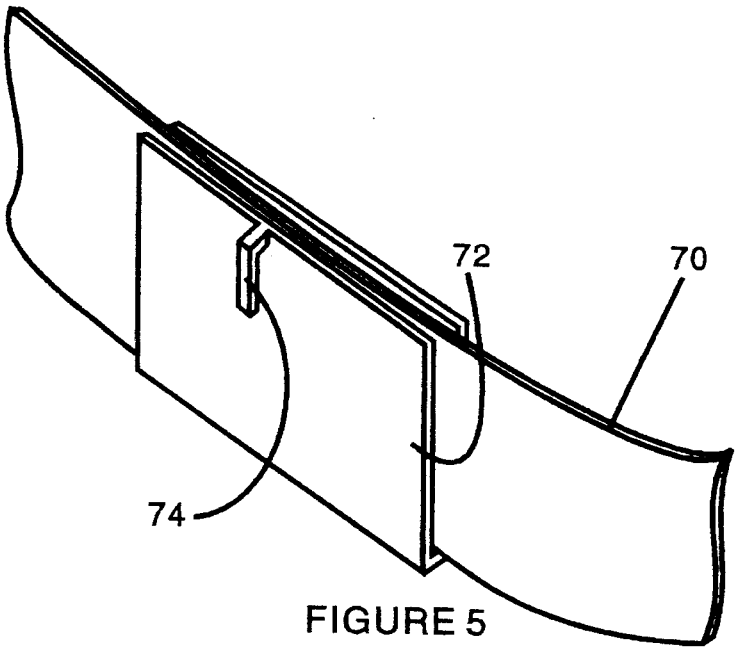
FIG. 5 is a view of the patient transfer belt with a clip for attaching the assist bands of the instant invention.
Figure 5A:
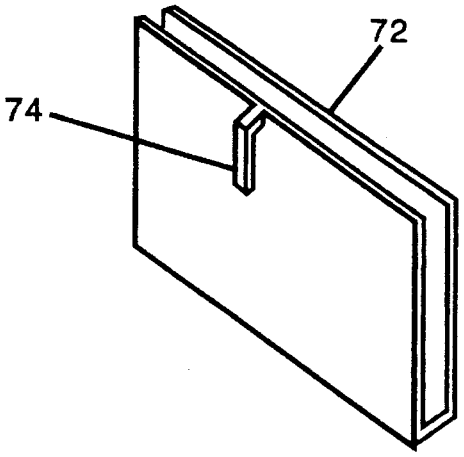
FIG. 5A is a view of the clip which receives a patient transfer belt and is attached to the assist bands of the instant invention.

A right elastic assist band 46 is connected to the lower leg 34B of right stabilizing bar 34. A left elastic assist band 48 is connected to the lower leg 34B of left stabilizing bar 36. The right elastic assist band 46 and left elastic assist band 48 are made of an elastic material and are designed to be attached to a harness or belt 70 which is worn by the patient by a right attachment element 46A and a left attachment element 48A. As best shown in FIGS. 4, 5, and 5A, the patient transfer belt 70 has a plurality of clip members 72 attached thereto. A central hook 74 is located on the clip member 72. The attachment elements, 46A and 48A, respectively, will attach to the central hook 74 of the clip 72. A plurality of clips 72 may be provided, equal to the number of assist bands employed. The right elastic assist band 46 is attached to element 34B by attachment hook 46B. The left elastic assist band 48 is attached to element 36B by attachment hook 48B. The patient would utilize self developed leverage, through the physical and mechanical relationship between the hand grip handle 38, the rear kick plate 23 and the right elastic band 46 and the left elastic band 48 when acquiring a raised position and would have a force imparted to them by the elastic bands. This force would help them acquire a raised position and assist them in mounting the patient transfer apparatus 10. It should be appreciated that when sitting, after the patient transfer stand 10 has been rotated that the elastic assist bands impart a force against the sitting motion, allowing the patient to sit in a more controlled and safe fashion. The elastic material may be neoprene, or any other elastic material with an appropriate modulus of elasticity.

Figure 3:
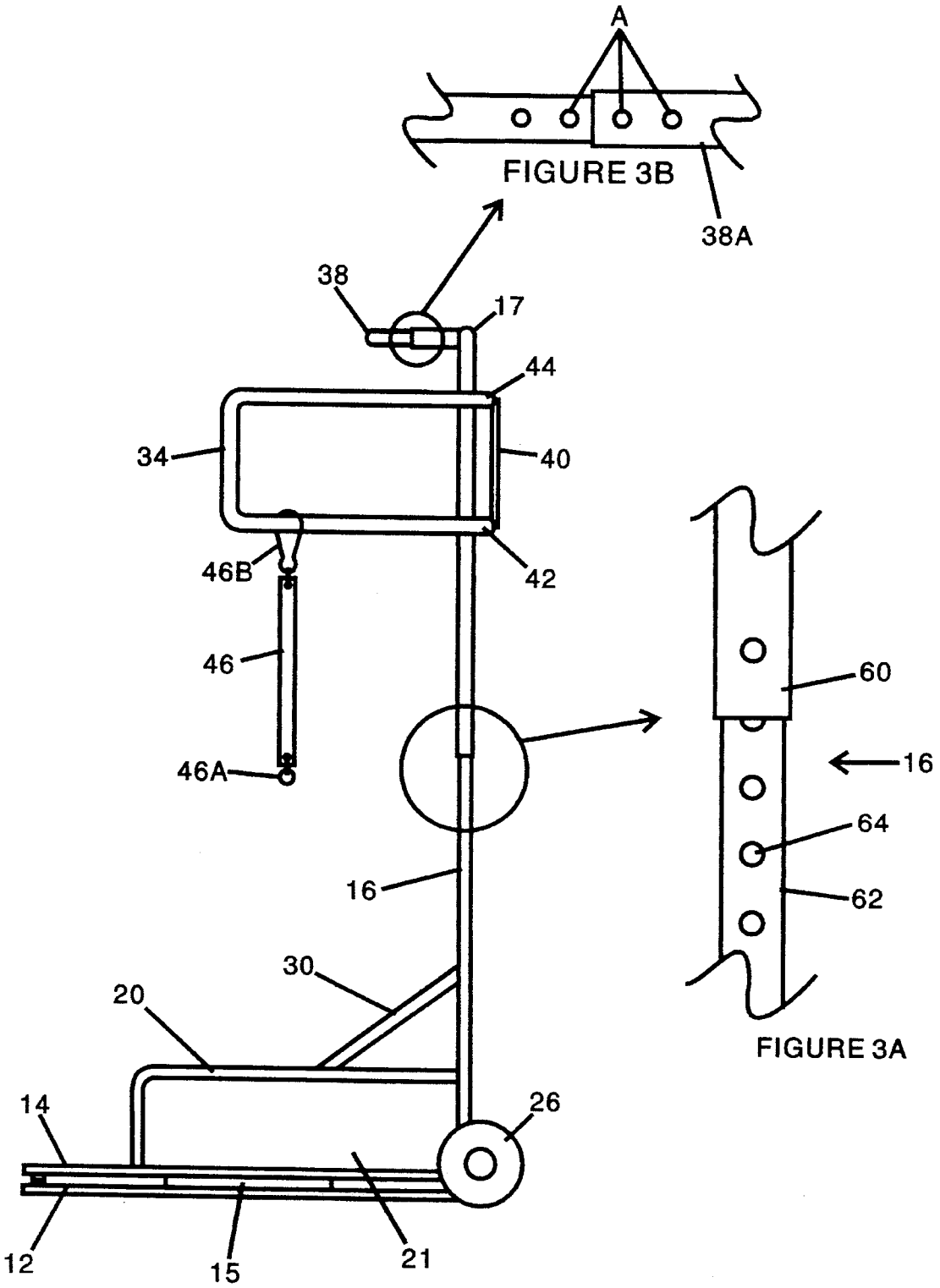
FIG. 3 is a side view of the patient transfer stand.

Referring now to FIGS. 3 and 4, the patient transfer apparatus 10 is shown. The top section 60 of the right vertical tube 16 is telescopically adjustable with the lower section 62 of the right vertical tube 16. The patient transfer apparatus 10 is symmetrical about the z-axis, therefore there exists an identical telescoping structure on the left vertical tube 18 which is not shown in the figures. Apertures 64 are designed to receive a mechanical device to maintain the vertical tube at an appropriate height for different sized individuals. Both the top section 60, and the lower section 62 have apertures located thereon. The top section 60 acts as the female section and the lower section acts as the male section in the telescoping relationship which is developed between the two elements. The mechanical device will have a locking feature which will guarantee its placement and prevent its accidental disengagement.

It is proposed that the tube structure be manufactured from a sturdy and reasonably inexpensive material, such as 6061 T-6 Aluminum tubing. It is to be understood; however, that any type of aluminum or other metals including steel may be utilized in the tubular construction. Certain plastics may also have the required material properties which would permit them to be utilized as the tubing material as well.

The tubing connections may be made by mechanical fasteners, by welding, by braising or by extruding sections as continuous tubing elements.

METHOD OF USING THE PATIENT TRANSFER STAND

The method of operation of this device is as follows from a wheelchair to a bed. First, the device is adjusted in appropriate manner to reflect the height of the patient. The wheelchair is brought into proximity of the apparatus, the wheelchair's wheels to be received in the left opening 50 and right opening 52 respectively. The patient braces his feet between the E-shaped patient stand 14 and the rear kickplate 23 in a wedge type fashion. The patient reaches up, and then depending on the severity of their condition, the right assist band 46 and the left assist band 48 would be attached to a belt or harness structure 70 which has a plurality of clips 72 attached thereto. The belt or harness structure 70 would be attached about the patient. A central hook 74 is located on each clip 72. The assist bands (46, 48) are attached to the central hooks 74 by a right attachment element 46A and a left attachment element 48A. The patient grabs the left stabilizing bar 36 and the right stabilizing bar 34 and utilizing leverage, as well as the force imparted to the patient by the elastic spring properties of the right assist band 46 and left assist band 48 stands up in a raised, semi-standing or erect fashion within the patient transfer stand 10. The assist bands (46, 48) will be primarily be utilized by those persons who are too weak to utilize the leverage as the sole means of standing erect. It is to be appreciated that the majority of patients may not need the assist bands. At this point the patient is then rotated away from the position of the wheelchair in such a fashion to place the bed right behind the patient. At this point the patient would sit down, the assist bands (46, 48) providing an oppositely directed reaction force which permits the patient to sit in a controlled and safe manner on the bed. The assist bands and the patient transfer belt are then removed and the patient reclines in the bed.

It is to be appreciated that the patient transfer stand 10 may employ more than two assist bands. Through utilization of more assist bands, patients of greater weight may be assisted in acquiring a transfer position in the transfer stand, and then returned to a sitting position in a safe and controlled fashion. The harness or belt described herein, to which the assist bands would be attached includes a plurality of clip members 72 which employ a central hook 74 which attach to the transfer belt 70. The central hooks 74 would provide attach points for the assist bands, allowing one to accommodate patients of any size, weight and strength.

The reverse of the aforementioned procedures would permit the patient to be transferred from the bed to the wheelchair.

It is apparent from the above that the present invention accomplishes all of the objectives set forth by providing a new and improved patient transfer apparatus incorporating means to transfer a patient in a safe and efficient manner, notwithstanding the patient's physical strength.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

I claim:

1. A patient transfer stand for permitting a wheelchair-bound person to be transferred to and from the wheelchair to another desired location comprising:

a base, a generally E-shaped platform arranged in spaced parallel relation above said base, rotation means, said rotation means supporting .said platform on said base for rotary motion thereon, a tubular structure secured to said platform, said tubular structure including two vertically spaced members having a bottom portion, an intermediate portion and a top portion, said top portion connected by a horizontal tubular member, a handle means, said handle means connected proximal said top portion, said handle means further including a left handle means and a right handle means, said platform having two generally rectangular apertures, said apertures designed to accommodate the wheels of the wheelchair, said right handle means having at least one right elastic member depending therefrom, said left handle means having at least one left elastic member depending therefrom, a pair of wheels, said pair of wheels secured to said tubular structure, whereby upon tilting of the apparatus the same may be wheeled, whereby said first elastic members and said second elastic members may be attached to the patient to facilitate the patient's mounting and dismounting of the said patient transfer stand.

2. The patient transfer stand of claim 1 wherein said intermediate portion has a first element in telescopic relation with a second element, said first element and said second element including apertures, said apertures designed to receive a mechanical securing means.

3. The patient transfer stand of claim 1 wherein said tubular structure is comprised of a metal.

4. The patient transfer stand of claim 3 wherein said metal is 6061 T-6 Aluminum.

5. The patient transfer stand of claim 1 wherein said right elastic member and said left elastic member are comprised of a rubber.

6. The patient transfer stand of claim 5 wherein said rubber is neoprene.

7. The patient transfer stand of claim 1 including a plurality of skid members, said skid members located intermediate said base and said platform, said skid members further rigidly attached to said platform, whereby said skid members prevent the tilting of said platform with respect to said base.

8. The patient transfer apparatus of claim 1 wherein said right elastic member includes a first patient attachment means, and said left of elastic member includes a second patient attachment means.

9. The patient transfer stand of claim 8 including a transfer belt, said belt to be worn by the person, said belt having a first clip and a second clip thereon, said first clip further having a first hook, and said second clip having a second hook, whereby said first patient attachment means and said second patient attachment means attach to first and second hooks respectively.

10. A patient transfer stand for permitting a wheelchair-bound person to be transferred to and from the wheelchair to another desired location comprising:

a base, a generally E-shaped platform arranged in spaced parallel relation above said base, rotation means, said rotation means supporting said platform on said base for rotary motion thereon, a tubular structure secured to said platform, said tubular structure including two vertically spaced members having a bottom portion, an intermediate portion and a top portion, said top portion connected by a horizontal tubular member, a handle means, said handle means connected proximal said top portion, said platform having two generally rectangular apertures, said apertures designed to accommodate the wheels of the wheelchair, said handle means having a plurality of elastic members depending therefrom, a pair of wheels, said pair of wheels secured to said tubular structure, whereby upon tilting of the apparatus the same may be wheeled, whereby said elastic members may be attached to the patient in order to facilitate the patient's mounting and dismounting of the said patient transfer stand.

11. The patient transfer stand of claim 10 wherein said intermediate portion has a first element in telescopic relation with a second element, said first element and said second element including apertures, said apertures designed to receive a mechanical securing means.

12. The patient transfer stand of claim 10 wherein said tubular structure is comprised of a metal.

13. The patient transfer stand of claim 12 wherein said metal is 6061 T-6 Aluminum.

14. The patient transfer stand of claim 10 wherein said plurality of elastic members are comprised of a rubber.

15. The patient transfer stand of claim 14 wherein said rubber is neoprene.

16. The patient transfer apparatus of claim 10 wherein said plurality of elastic members includes a patient attachment means.

17. The patient transfer stand of claim 16 including a transfer belt, said belt to be worn by the person, said belt having a clip means thereon, said clip means further having a hook means, whereby said patient attachment means attaches to said hook means.

* * * * *